United States Patent [19]

Schwartz

[11] 4,385,762

[45] May 31, 1983

[54] ELECTRONIC MATCHING AND INFORMATION ASSOCIATION GAME

[75] Inventor: Roland Schwartz, Paris, France

[73] Assignee: Comano S.A., La Varenne St. Hilaire, France

[21] Appl. No.: 143,547

[22] Filed: Apr. 25, 1980

[30] Foreign Application Priority Data

Apr. 27, 1979 [FR] France ..... 79 10923
Dec. 5, 1979 [FR] France ..... 79 29885

[51] Int. Cl.[3] ..... G09B 19/00; A63F 9/00

[52] U.S. Cl. ..... 273/1 GC; 273/1 GE; 273/237; 434/259; 434/340

[58] Field of Search ..... 273/16 C, 16 E, 238; 434/259, 338, 340, 341, 343, 344

[56] References Cited

U.S. PATENT DOCUMENTS 3,154,862 11/1964 Culpepper, Jr. ..... 434/335
3,710,455 1/1973 Liuersidge et al. ..... 273/273
3,760,511 9/1973 Matsumoto ..... 434/259
3,996,671 12/1976 Foster ..... 434/323
4,169,592 10/1979 Hall ..... 434/258
4,176,470 12/1979 Fosner et al. ..... 434/259
4,274,638 6/1981 Jullien ..... 273/138 A

*Primary Examiner*—Vance Y. Hum
*Assistant Examiner*—Leo P. Picard
*Attorney, Agent, or Firm*—Birch, Stewart, Kolasch & Birch

[57] ABSTRACT

The present invention relates to a game including a set of pieces having different outlines or otherwise differently configured whereby each is engageable into an individual location on a playing surface e.g. by insertion therein. A set of display elements each associated with one of the locations may be activated to indicate visibly when a piece is to be engaged with its associated location. A switch associated with each location is so arranged as to be operable when, and only when, the piece of the correct configuration is engaged in the location. An electrical operating circuit activates the display elements successively in an initial period and then activates only one display element. When the correct piece is engaged with the location corresponding to the activated display element the control circuit responds by deactivating the display element or by adjusting the sound from a sound source.

26 Claims, 14 Drawing Figures

ELECTRONIC MATCHING AND INFORMATION ASSOCIATION GAME

BACKGROUND OF THE INVENTION

The present invention concerns an educational game, in particular for children.

At a time when audio-visual means are developing at a pace such that even children cannot escape the power of such means and often become the privileged target thereof, it is necessary to bring children out of this incident-filled setting and teach them to overcome the passiveness in which modern-day society in inexorably immersing them.

The education of children has therefore gradually been converted into a question of schooling them in reflection and intelligence.

For the youngest of children, games are still excellent means of education. However, it is no longer reasonable to try to retain the attention of young children, without making use of the latest fashion which gives them the impression of being up-to-date in their manner of life.

This analysis is the basis of the novel game proposed by the present invention, which seeks to offer, essentially to children, modern means capable of developing their faculties of associating ideas or establishing relationships.

For this purpose, the present invention concerns an educational game characterised in that it comprises a support arrangement, a first carrier member which is mounted on the support arrangement and on which is disposed a first series of pieces of information, at least one second carrier member on which there is disposed a second series of pieces of information which can be respectively associated with those of the first information series, and a signalling means comprising at least one series of display elements for displaying another piece of information, which are disposed on said first carrier memeber of the support arrangement. One of said display elements corresponds to each piece of information of said first information series, means are provided for actuating the signalling means and for causing said other piece of information to appear first successively at said display elements and then, after a given period, at only one of said display elements, and a series of means are provided which are associated respectively with the pieces of information of said first information series and which are so arranged that the association of the piece of information of said first information series, corresponding to the display element at which, after said given period, said other piece of information appears, with the corresponding piece of information of said second information series, causes said other piece of information to disappear.

The signalling means may also comprise a sound source disposed in the support arrangement, being intended to be actuated at the end of the given period after which said other information appears at only one of said display elements, and, instead of the association in question causing said other information to disappear, it modulates the emission of the sound source.

In an embodiment of the game of the invention, the means for actuating the signalling means are so arranged as to cause said other information to appear at the display elements in a random fashion.

In this case, the essential interest of the game is selecting, from the information of the second information series, that piece of information which is to be associated with the piece of information of the first information series corresponding to the display element at which said other piece of information appears, in order to cause said other piece of information to disappear, without the player of the game having been able beforehand to have the slightest idea about the end result of the display sequence.

If a number of players are playing the game, and if each of them has the same second information series, the winner is that player who, in each display sequence, makes the necessary association first. The game therefore involves on the one hand a capacity for associating ideas and on the other hand, speed of thought.

For the attention of children, the information in question may be images illustrating events, for example a series of accidents with which the players are required to associate complementary images illustrating suitable rescue means, for example a shipwreck and a lifeboat, or a fire in a building and a fire tender. The game may also involve associating colors, numbers, shapes, volumes, etc.

The display elements may advantageously be light sources such as lamps which an electrical signalling means causes to flicker in turn but in a random order, each display sequence concluding with a single lamp being continuously lit.

Thus, the game of the present invention also involves the idea of a lottery, with the group of flickering lamps symbolizing the rotating wheel. However, if, in a lottery, the position in which the wheel is going to stop remains uncertain for a long period of time, that uncertainty is greatly reduced and even becomes zero, with the speed of the wheel. It is certain that developing the capacity for associating ideas, in a child, would still occur with a conventional lottery, but, when a number of players are playing the game, the game would lose a major part of its interest, which is to arrive at the association of information before the other players. In order to conclude this comparison, it may be claimed that, in this embodiment, the invention provides a lottery wherein the rotating wheel would be driven in rotation in both directions and in a random manner, before being abruptly stopped.

It should be noted that, even in the event that the means for actuating the display sequence do not cause the lamps to flicker in a random fashion, it is possible that the game is still comparable, obviously only in part, to a lottery. In fact, when a display sequence has been triggered off and then stopped at a given lamp, by a player having arrived at the association of respective pieces of information, the means for actuating the display sequence can be so arranged that a player, for example the winner, can trigger off a fresh display sequence, starting from the lamp which would have flickered at the moment that the fresh sequence was triggered off, if the display sequences had succeeded each other and had been renewed without interruption, or if only the fresh sequence had been triggered off when the previous sequence was stopped. It will be seen then that the time taken by the winner of a given sequence, to make the necessary association and to trigger off the following sequence, varies from one sequence to another, or from one player to another, with the result that the players can never know which lamp will be the starting point of a sequence. By having a relatively high frequency for flickering of the lamps, the players will not be able to follow the flashing or flickering of the lamps, and they will not even be able to visually determine the lamp at which the sequences start, and the lamp at which each of the sequences will stop will therefore remain undetermined. In the opposite case, with the number of lamps being limited by virtue of construction restraints, knowledge of the lamp which forms the starting point of the sequence would obviously make it possible to decide which lamp would form the end of the sequence. It will be appreciated therefore that, in that case also, the flickering of the lamps appears to be random or virtually random.

In a preferred embodiment of the game of the invention, the means which are associated with said first information series and which are arranged so as to cause said other piece of information to disappear or so as to modulate the emission of the sound source, comprise an insulating card which is disposed within the support arrangement, and a series of pairs of conducting pellets printed on the card, the pairs of pellets being connected in parallel and being respectively associated with the pieces of information of the first information series and being arranged so that two pellets of the same pair are short-circuited upon association of the corresponding piece of information of said first series with the corresponding piece of information of the second series.

In this case, there may be provided a series of pairs of conducting studs which are respectively associated with the conducting pellets, in contact therewith, by way of one of their ends, and which project, by way of their other ends, out of the carrier member on which the first information series is disposed, and a series of cards which respectively carry the information of the second information series, each card comprising a metallized layer covered with an insulating coating, except for two given regions, by way of which it is intended to cooperate with one of the pairs of studs, by way of said other end, in order to short-circuit said studs and therefore the associated pellets.

Equally however, it may be provided that the pieces of information of said second information series are respectively carried by carrier members of different given shapes. The carrier member on which the information of the first information series is disposed may include recesses shaped to receive respectively the carrier members carrying the second pieces of information. Provided in the support arrangement is a series of conductor means which are respectively associated with the first pieces of information and which are arranged so that, against the action of resilient return means and when one of said carrier members carrying a second piece of information is engaged into the corresponding opening of the carrier member carrying the first pieces of information, the pellets of the pair associated with the corresponding first piece of information are shortcircuited.

BRIEF DESCRIPTION OF THE DRAWINGS

The invention will be better appreciated by means of the following description of a number of embodiments of the game according to the invention, with reference to the accompanying drawings wherein.

DETAILED DESCRIPTION OF THE INVENTION

Figure 1:
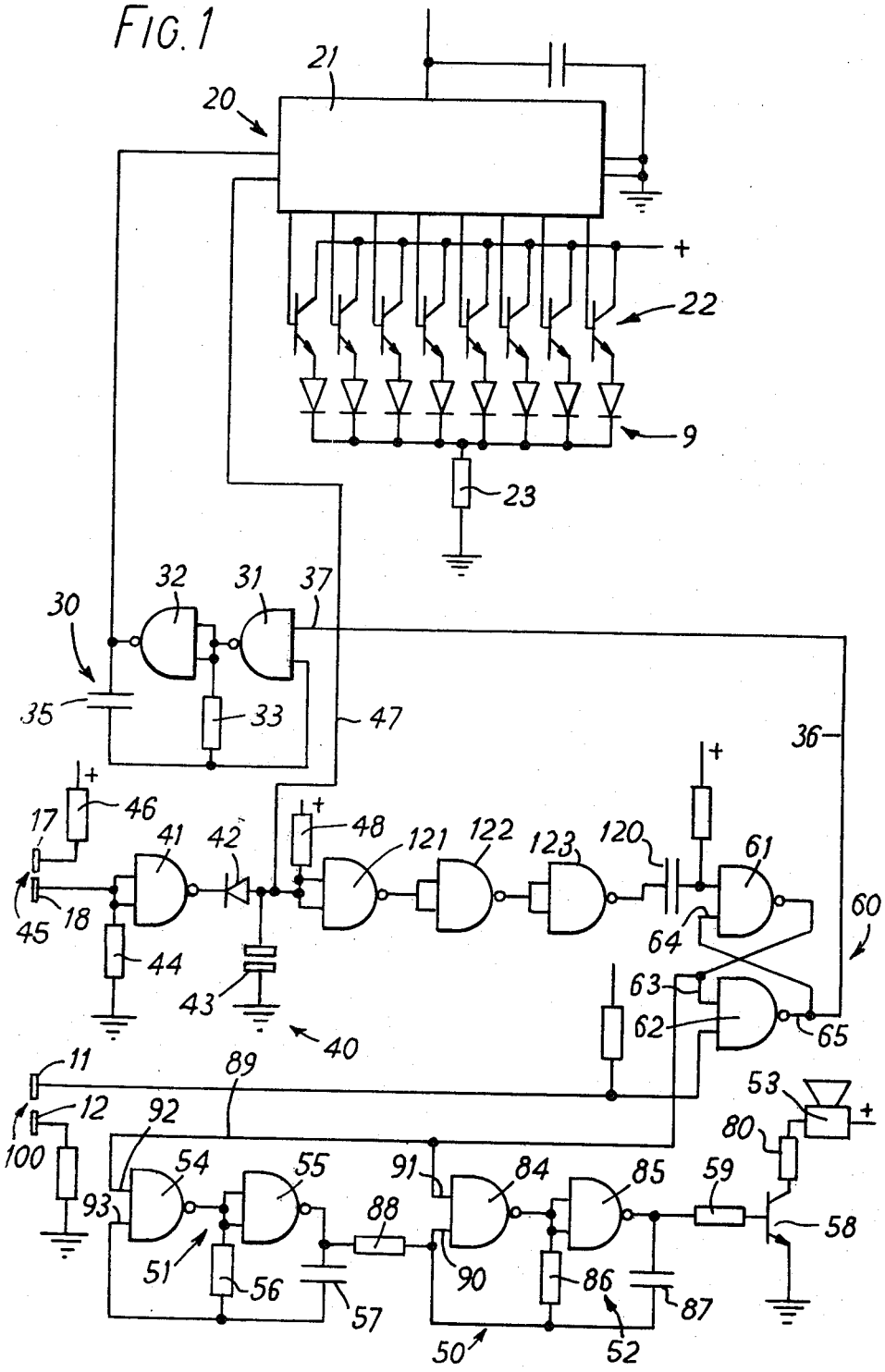
FIG. 1 shows an electrical diagram of the signalling and sound-producing device of the game of the invention.

The game shown in the drawings, in its different embodiments, comprises a support arrangement within which there is disposed a signalling and sound-producing device which is common to all the embodiments.

We shall therefore first consider the signalling and sound-producing device shown in FIG. 1.

The device comprises a series of light-emitting diodes 9, a circuit 20 for controlling the diodes 9, an oscillator 30 for controlling the circuit 20, a clock circuit 40, a tonality circuit 50 and a tonality control circuit 60. It will be appreciated that the signalling circuit comprises a power source, for example a battery, and a general actuating switch which will be described hereinafter.

The circuit 20 for controlling the diodes 9 comprises an electronic counter 21 comprising a number of outputs equal to the number of diodes, there being eight outputs and diodes in the present case, and a series of eight current amplifiers 22, each of which comprises a transistor, and which are connected respectively between the positive terminals of the diodes 9 and the counter 21, in order to increase the intensity of the light produced by the diodes, which otherwise would not be sufficient. The intensity of light produced by the diodes is also controlled by a resistor 23 connected to all the negative terminals of the diodes 9.

The diodes 9 are caused to flicker or flash in a random fashion, by virtue of suitable connection thereof to the control circuit 20. The control oscillator 30 comprises two NAND-gates 31 and 32, with the two inputs of the gate 32 being connected to the output of the gate 31 and the output of the gate 32 being connected to the input of the counter 21. The oscillator 30 also comprises a resistor 33 connected between the output and one of the inputs 34 of the gate 31, and a capacitor 35 which is connected between the output of the gate 32 and the input 34 of the gate 31. The oscillator 30 provides the pulses for controlling the counter 21. The frequency of the control pulses is determined by the value of the resistor 33 and the capacitance of the capacitor 35, the period of the output pulses varying with the value of the resistor 33 and/or the capacitance of the capacitor 35.

A line 36 is connected to the other input 37 of the gate 31, for disabling or taking out of service the oscillator 30, as long as the tonality is not zeroed, as will be described hereinafter.

The clock circuit 40 essentially comprises a NAND-gate 41, a diode 42, a low-leakage capacitor 43, for example of tantalum type, and a resistor 44. The resistor 44 is connected to the input terminals of the gate 41 whose output is connected to the negative terminal of the diode 42, with the capacitor 43 being connected to the positive terminal of the diode 42. The inputs of the gate 41 are kept at zero potential by the resistor 44. A sequence-initiating contact-maker 45 is provided so that, when it is actuated, it causes the input of the gate 41 to assume its high state, by way of a resistor 46, thus causing the output of the gate 41 to assume its low state. With the gate 41 in this state, the capacitor 43 discharges through the diode 42 which in turn enables the counter 21 by way of a line 47. As long as the contact-maker 45 is actuated, the capacitor 43 remains discharged and the counter 21 remains enabled. When the contact-maker 45 is released, the capacitor 43 is recharged through a resistor 48 connected to the junction of the capacitor 43 and the diode 42. When the potential of the capacitor 43 reaches approximately half the supply voltage, the threshold voltage of the gate 41 is reached and the counter 21 is disabled. The period of time required for the potential of the capacitor 43 to reach half the supply voltage is determined by the values of the resistor 48 and the capacitance of the capacitor 43.

The tonality circuit 50 comprises two oscillators 51 and 52 for feeding a loud-speaker 53 which is connected in series with a resistor 80, by way of a single-stage amplifier 58, which in the present case is a transistor connected to the oscillators 51 and 52 by way of a resistor 59. The oscillator 51 is a low-frequency oscillator which, by way of a resistor 88, modulates the base oscillator 52 so as to produce a sound comprising two pitches alternately.

The oscillator 52 comprises two NAND-gates 84 and 85, the inputs of the gate 85 being connected to the output of the gate 84, a resistor 86 connected between the output of the gate 84 and one of its input 90 and a capacitor 87 connected between the output of the gate 85 and the input 90 of the gate 84, the oscillator 51 also comprising two NAND-gates 54 and 55, a resistor 56 and a capacitor 57 which are arranged in an identical circuit to that of the oscillator 51. The level of the sound is inversely proportional to the value of the resistor 80. The two oscillators are put into service or enabled by a line 89 connected to the other input 91 of the gate 84 and to the input 92 of the gate 54, other than the input 93 to which the resistor 56 and the capacitor 57 are connected.

The tonality control circuit 60 comprises two NAND-gates 61 and 62, with the output of the gate 61 being connected to an input 63 of the gate 62, and an input 64 of the gate 61 being connected to the output 65 of the gate 62 which is itself connected to the line 36 for disabling the oscillator 30. The circuit 60 is connected to the circuit 40 by way of a capacitor 120 and three NAND-gates 121, 122 and 123.

A series of parallel-connected contact-makers 100, only one of which is shown in FIG. 1, the two terminals of each contact-maker being formed by two conducting pellets 11 and 12 which will also be described in greater detail hereinafter, are provided for enabling the oscillator 30 for controlling the counter 21, disabling the tonality oscillators 51 and 52 and thus stopping the emission of the tonality. As regards emission of the tonality, this is caused by the charge of the capacitor 43 at the moment that the potential thereof reaches half the supply voltage: when the threshold voltage is achieved, approximately half the value of the supply voltage, the output of the gate 61 switches into its high state and enables the oscillators 51 and 52 by way of the line 89.

It is only after the oscillators 51 and 52 have been disabled by way of a contact-maker 100 that the counter 21 can operate again.

Figure 2:
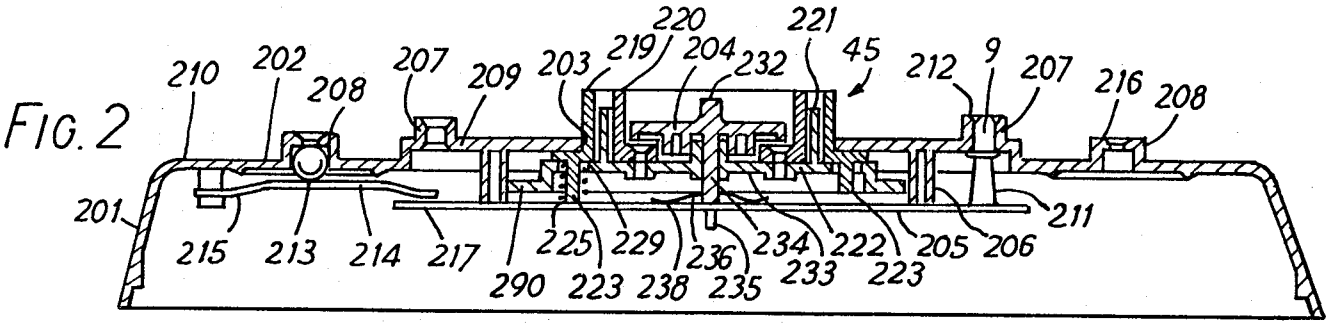
FIG. 2 shows an axial cross-section of the support arrangement of a first embodiment of the game of the invention.

Referring now to FIG. 2, a first embodiment of the game according to the invention comprises a support arrangement 201 of general frustoconical shape, within which is disposed the signalling and sound-producing circuit of FIG. 1 which however is not shown in FIG. 2. The support arrangement is provided with an upper circular portion 202 which is of a particular shape and which is preferably moulded in one piece with the support arrangement, and a circular base (not shown as it is not a characteristic) which is connected to the support arrangement 201 to close it, for example by welding or adhesive. For reasons which will become more clearly apparent hereinafter, the support arrangement, with its upper part and its base, is preferably made of a material which does not conduct electricity.

The upper portion 202 comprises a central opening 203 intended to receive the general actuating switch 204 and the static sequence-initiating contact-maker 45.

An insulating card 205 is also disposed within the support arrangement 201 and is fixed to the upper portion 202 by bracer means 206.

The upper portion 202 is divided into a given number, which is eight in the embodiment illustrated, of equal sectors, each of which comprises two receiving housings 207 and 208 whose receiving opening is directed inwardly of the support arrangement and which are slightly offset radially and angularly at the surface of the upper portion 202. The upper portion 202 has two levels 209 and 210, the central level 209 being substantially higher than the peripheral level 210, relative to the base of the support arrangement, the housings 207 and 208 respectively projecting from those levels.

Housed in each of the housings 207 is one of the above-described light-emitting diodes 9 which is visible through a window 212 provided in the upper part of the housing 207. The eight diodes 9 are mounted on stems or legs 211 which are fixed to the card 205 and which are electrically connected to the signalling and sound-producing circuit of FIG. 1 by way of a conventional conductor circuit printed on the card 205.

Housed in each of the housings 208 is a ball 213 which is held in its housing by a flexible blade 214 which is fixed to the internal wall of the upper portion 202, at one of its ends 215. Besides its flexibility which permits it to perform a resilient return function of urging the ball 213 into the bottom of its housing, the blade 214 also has the particular feature of being conducting, at least at its other end 217.

An opening 216 is provided in the upper part of each housing 208 so that means described hereinafter can push the ball 213 housed therein downwardly, against the force of the corresponding blade 214, thus causing the blade 214 to flex about its end 215 so that its other end 217 comes into contact with the surface of the card 205 which is towards the upper portion 202 of the support arrangement. It will be noted in this respect that the length of the blade 214 and the dimensions of the card 205 are linked to each other.

Figure 3:
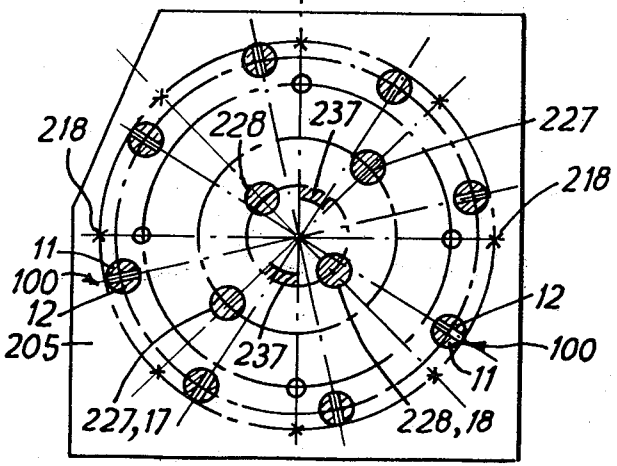
FIG. 3 shows a plan view from above the insulating card of the support arrangement of FIG. 2.

Besides the conductor circuit referred to hereinbefore, the conducting pellets 11 and 12 which in pairs form the contact-makers 100 already referred to above with regard to the signalling circuit of FIG. 1, are printed on the card 205. It will be noted here also that the electrical junctions of the diodes to the signalling circuit, on the circuit printed on the card 205, illustrated at 218 in FIG. 3, are slightly offset angularly with respect to the pairs of pellets 11 and 12.

Eight pairs 100 of pellets 11 and 12 are thus regularly printed along a circumference on the surface of the card 205 so as to be respectively disposed below the ends 217 of the eight blades 214.

When a ball 213 is actuated, the end 217 of the associated blade 214 comes into contact with the two pellets 11 and 12 of the corresponding pair, so as consequently to short-circuit them and thus enable the oscillator 30, disable the oscillators 51 and 52 and modulate or preferably stop the emission of the tonality.

The sequence-initiating contact-maker 45 comprises two coaxial ring members of general cylindrical shape, an external ring member 219 and an internal ring member 220, which are held in the opening 203. The ring members which are produced for example from a plastics material are metal-plated over their entire surface and are insulated from each other by an external cylindrical sleeve 221 of a member 222 which is also intended for fixing the ring members 219 and 220.

In its lower part, the ring member 219 is provided with two diametrically opposed peripheral lugs 223 while the ring member 220 is also provided, in its lower part, with two central lugs 224 which however are diametrically opposed with respect to the axis of the ring member.

Metal springs 225 and 226 are respectively mounted on the lugs 223 and 224. When the ring members are in position, the springs 225 and 226 are intended to bear against pellets 227 and 228 printed on the card 205. The pellets 227 and 228 which are electrically connected together in pairs respectively form the two terminals 17 and 18 of the contact-maker 45 of FIG. 1. In order to actuate the contact-maker 51, it is sufficient to short-circuit the two terminals 17 and 18, for example by simultaneously touching the two ring members 219 and 220 which are metal-plated for this purpose, by means of a finger, the electrical connection being made by way of the metal springs which are disposed and fixed along the side wall of the support arrangement, actuation of the contact-maker consisting of short-circuiting the two strips.

Figure 4:
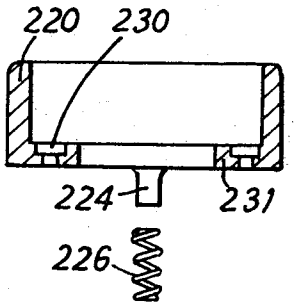
FIG. 4 shows an axial cross-section of the internal ring member of the sequence-triggering contact-maker of the game of the invention.

As shown in FIGS. 2 and 4, the external ring member 219 is held in place in the opening 203 by the upper portion 202 of the support frame 201 against which an annular external shoulder 228 of the ring 219 is in abutment, and by the member 222, under the shoulder 229, secured to the upper portion 202 of the support arrangement 201, for example by screws (not shown), which extend through openings 290 provided in the member 222.

The inner ring member 220 is fixed to the insulating member 222, for example by screwing, openings 230 being provided for this purpose in an internal annular shoulder 231 of the ring member 220.

The general actuating switch 204 comprises a button 232 which is mounted on a small internal cylindrical sleeve 233 of the member 222 and within the ring member 220, the button includes an axis portion 234, for example of rectangular cross-section, whose end 235 extends through a central opening in the card 205, and a shoulder being provided on the end 235 in order to bear against the card 205.

Mounted on the axis portion 234 adjacent its end 235 is a flexible conducting blade 236 whose two ends 238 bear against the card 205. Two circular conducting ring portions 237 are printed on the card 205, the mean diameter of the conducting ring corresponding to the distance between the two ends 238 of the blade 236. The game is set in operation by short-circuiting the two printed portions 237 by means of the blade 236, that is to say, by turning the button 232, for example through a quarter of a turn.

The button 232 is held in position for example by means of a clip (not shown) mounted on the end 235 of the axis portion 234, under the card 205.

The support arrangement 201 as described hereinbefore may have associated therewith different carrier rings on each of which is disposed a first series of pieces of information.

The rings are so arranged as to be placed on the support arrangement 201 and co-operate with the upper portion 202 to whose shape they may be adapted, the rings being fixed on the support arrangement in conventional manner, for example by clipping or by simple positive cooperation of shapes.

Each of the rings is also divided into eight identical sectors, each of which comprises one of said first pieces of information and which are intended to be respectively associated with the eight sectors of the upper portion 202 of the support arrangement, with their respective housings 207 and 208 or with their respective diodes 9 and balls 213.

Figure 5:
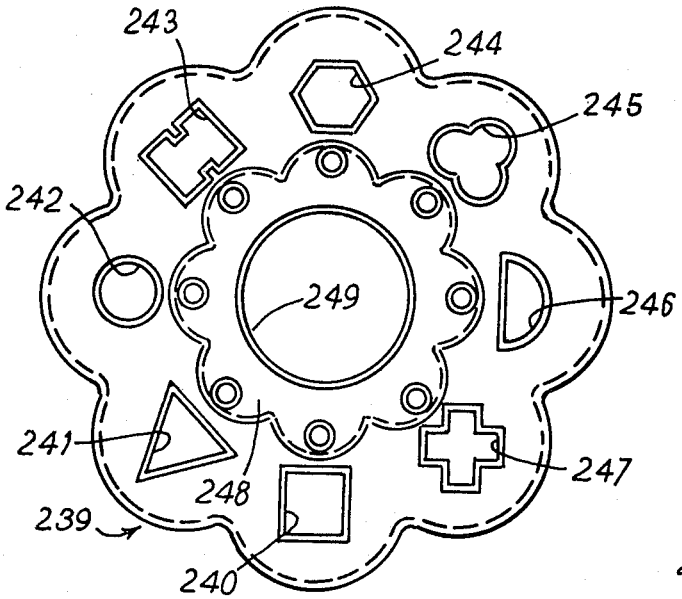
FIG. 5 shows a plan view from above of a carrier ring for carrying the first pieces of information relating to volumes, corresponding to the support arrangement shown in FIG. 2.

The carrier ring 239 in FIG. 5 thus comprises pieces of information relating to volumes. Eight recesses 240 to 247 are provided in the respective sectors, at the periphery thereof; the shapes of the recesses 240 to 247 correspond to the vertical projection of eight different right cylindrical volumes, for example a square 240 corresponding to a cube, a triangle 241 corresponding to a prism, a circle 242 corresponding to a cylinder of round cross-section, and so on. The eight volumes are also illustrated on an internal circular portion 248 of the ring 239, in respective ones of the eight corresponding sectors of the ring.

A central opening 249 is provided in the ring 239 for the contact-maker 45 and for the general actuating switch.

Figure 7:
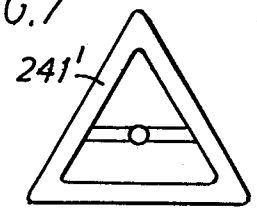
FIG. 7 shows a plan view from above of a first piece of information regarding volume, corresponding to the carrier ring of FIG. 5.
Figure 8:
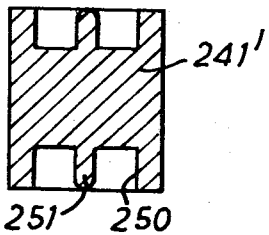
FIG. 8 shows a view in vertical section of the volume member shown in FIG. 7.

The right cylindrical volumes 240' to 247' corresponding to the recesses 240 to 247 in the ring 239, and representing the second series of information, are components which are for example moulded and whose lower portion is so arranged as to be fitted on to the housings 208 of the upper portion 202 of the support arrangement 201. Thus, FIGS. 7 and 8 show a right prism 241' comprising a bottom annular groove 250 having the same outside diameter as the housings 208 and providing a central lug portion 251 which is adapted to engage into the opening 216 in the housings 208. It is these lug portions 251 which, against the action of the blades 214, push the balls 213 to short-circuit the pellets 11 and 12 when said volumes are introduced into the corresponding recesses of the carrier ring. It will be noted that the members 240' to 247' are actually symmetrical with respect to their horizontal central plane.

Having now described a first embodiment of the support arrangement of the game according to the invention, with a first type of ring for carrying first pieces of information and the second series of pieces of information associated therewith, the rules and the mode of use of the game can now be described.

We shall now consider the manner in which the game is played, starting from the moment at which one of the diodes 9 is still lit, the tonality being stopped. A player then operates the contact-maker 45 causing the capacitor 43 to discharge, the counter 21 to be enabled and the flashing sequence of the diodes 9 to be initiated. As soon as the player removes his finger from the contact-maker 45, the capacitor is re-charged and, when its potential reaches approximately half the supply voltage, the tonality is triggered, the counter 21 is disabled and a fresh diode 9 is lit.

At that moment, the players must hurry to select from the eight volumes 240' to 247' which are before them, that one which corresponds to the illustration of the circular portion 248 of the ring 239 which is associated with the lighted diode 9. The first of the players who takes the appropriate volume introduces it into the corresponding recess in the ring 239 and the lug portion 251 of the inserted member presses against the corresponding ball 213 which in turn displaces the end 217 of the corresponding blade 214, causing it to bear against the two associated pellets 11 and 12 which are thus short-circuited.

Then, a switch 100 having been actuated, the tonality ceases to sound. The winner of this section of the game re-actuates the contact-maker 45 in order to trigger off a new round of the game, and so on. It will be noted that it is impossible for a volume 240' to 247' to be introduced into a recess 240 to 247 which does not correspond thereto.

Figure 6:
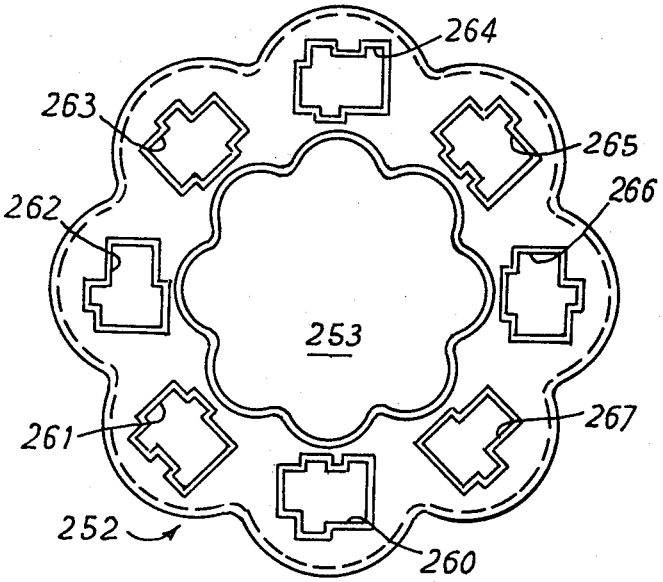
FIG. 6 shows a plan view from above of another carrier ring for carrying first pieces of information relating to surfaces, animals and colors, corresponding to the support arrangement of FIG. 2.
Figure 11:
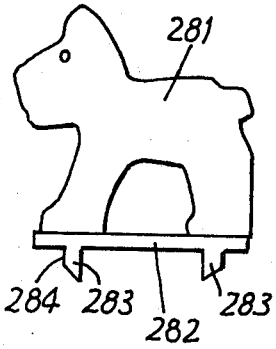
FIG. 11 shows a front view of an animal piece of information, corresponding to the carrier of FIGS. 9 and 10.

The carrier ring 252 in FIG. 6 is similar in its general structure to that shown in FIG. 5. However, the inner circular portion 248 of the ring 239 is replaced in the ring 252 by one of the discs of a plurality of removable discs 253 on which, as in the case of portion 248, a plurality of series of first pieces of information, for example surfaces, animals or colors, are respectively represented. In addition, the recesses 260 to 267 of the ring 252 no longer correspond to particular volumes, in accordance with what was considered hereinbefore, but only correspond to right cylindrical carriers 260' to 267' which are so arranged as respectively to receive the pieces of information of the second series of pieces of information which are associated with those on one of the discs 253. The carriers for the second information series are small right cylinders which are small in height and which are of particular and quite different horizontal sections. The shapes of the recesses 260 to 267 in the ring 252 respectively correspond to the sections of the carriers.

The carriers are hollow members which are for example moulded and which have their lower part arranged so as to be fitted on to the housings 208 of the support arrangement 201.

Figure 9:
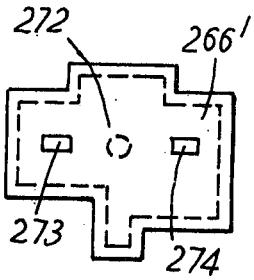
FIG. 9 shows a view from below of a carrier member for a second piece of information, corresponding to the carrier ring of FIG. 6.
Figure 10:
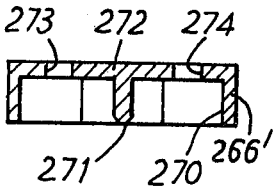
FIG. 10 shows a view in vertical section of the carrier member of FIG. 9.

Thus, FIGS. 9 and 10 show one of the carriers 266' which is of polygonal section and which has adjacent faces perpendicular and which, in its lower part, has an annular groove 270 whose outside diameter is the same as that of the housings 208, providing a central lug portion 271 adapted to engage into the opening 216 of the housings 208, just like the volumes 240' to 247'. The supports 260' to 267' are set in position on the ring 252 in the same manner as the members 240' to 247' were set in position on the ring 239, the lug portions 271 carrying out the same function as the lug portions 251. It will be noted that the carrier members in themselves constitute the second pieces of information relating to surfaces, as referred to above.

In addition, the upper part 272 of the carriers acts as a base for receiving a said second piece of information relating to animals or colors. For this purpose, the base 272 comprises two openings 273 and 274.

The pieces of information relating to colors or animals are carried by colored counters 280 and shaped members 281 representing the animals in question, which are respectively mounted on bases 282 which in their lower portion comprise two legs 283 including, at their free end, an outwardly projecting shoulder 284.

Depending on whether one or the other of the three discs 253 is used, only the carriers 260' to 267' alone are used or the counters 280 or the shaped members 281 are mounted on the carriers. For that purpose, the legs 283 of the bases 282 are introduced into the openings 273 and 274 in the base portions 272 of the carriers respectively, the shoulders 284 which are disposed at a distance from the bottom face of the bases 282 which is equal to the thickness of the base portions 272 of the carriers locking the counters or shaped members to the corresponding carriers.

The rules of the game, with the ring 252, one of the three discs 253, the carriers 260' to 267' alone or with colors counters 280 or animal-shaped members 281, are the same as in the case of the game using the ring 239 and the volume members 240 to 247'.

Figure 13:
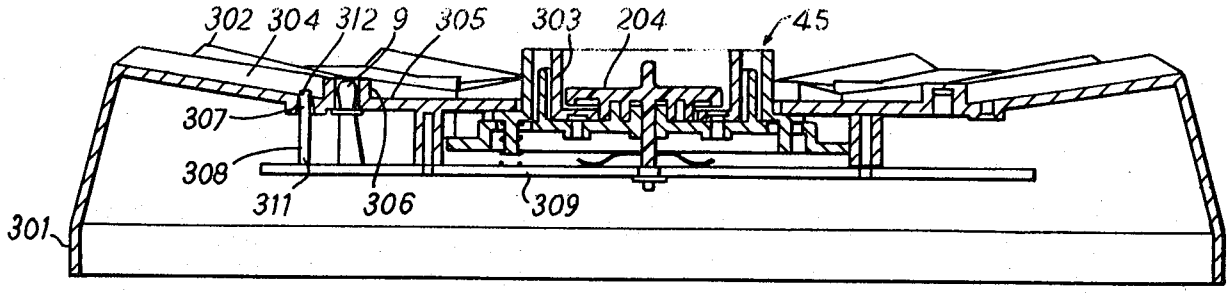
FIG. 13 shows a view in axial section of the support arrangement of a second embodiment of the game according to the invention.
Figure 12:
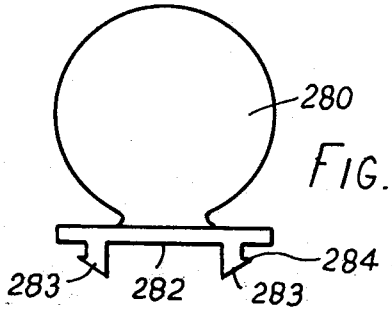
FIG. 12 shows a front view of a piece of color information corresponding to the carrier member of FIGS. 9 and 10.

Referring now to FIG. 13, a second embodiment of the game according to the invention comprises a support arrangement 301 which is identical to the support arrangement 201 and within which is disposed the signalling and sound-producing circuit of FIG. 1, and which is provided with a circular upper portion 302 which is of a particular shape and which is moulded in one piece with the support arrangement, and a bottom portion. The support arrangement 301 with its upper portion and its bottom portion is preferably made of a material which does not conduct electricity.

The upper portion 302 comprises a central opening 303 for receiving the general actuating switch 204 and the sequence-initiating contact-maker 45 as described above.

The upper part 302 is divided into a given number, which in the embodiment illustrated is eight, of equal sectors so arranged as to receive and co-operate with carrier cards for carrying second pieces of information as described hereinafter. Each sector comprises a planar slightly inclined face 304 which extends from the periphery of the sector to a position approximately halfway along the radius of the upper portion 32. Disposed on the face 304 is a first piece of information which is to be associated with the information on one of the carrier cards. Between the inclined face 304 and the opening 303, the surface 305 of the sectors is horizontal, or parallel to the bottom portion of the support arrangement. Provided in the horizontal portion 305 of the sectors, in the vicinity of their inclined face, is an opening 306 for housing a diode 9 as already described above, the opening projecting from the horizontal portion. Provided in the inclined face 304 of the sectors, in the vicinity of their horizontal face, is a plurality of openings 307, there being five such openings in the embodiment illustrated, for receiving conducting studs 308.

An insulating card 309 is also disposed within the support arrangement 301, being fixed in the same way as the card 205 in the support arrangement 201. The diodes 9 are mounted on the card 309 and are electrically connected to the signalling circuit of FIG. 1 by a conductor circuit printed on the card 309, in the same way as in the case of the support arrangement 201.

Figure 14:
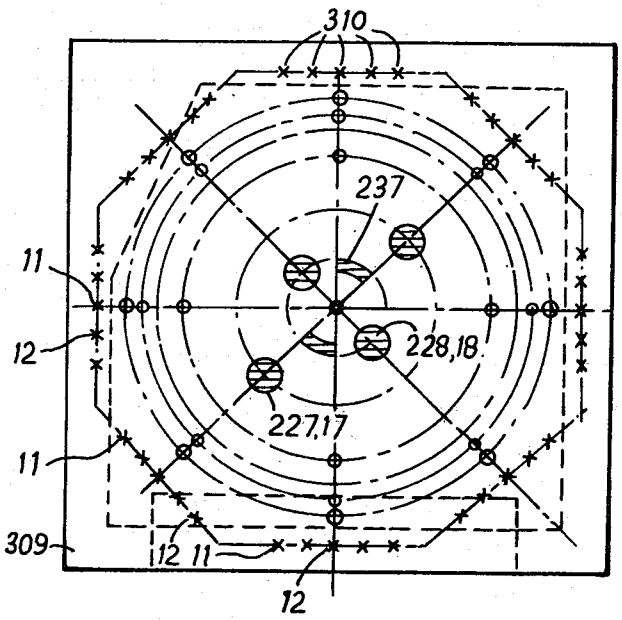
FIG. 14 shows a plan view of the insulating card of the support arrangement shown in FIG. 13.

The card 309 is divided into eight sectors each comprising two conducting pellets 11 and 12 which are printed on the card at two points selected from five which are illustrated at 310 in FIG. 14. The sectors of the card correspond to those of the upper portion 302 of the support arrangement 301 and the five points 310 of each card sector correspond to the five openings 307 in each inclined face 304 of the support arrangement 301.

The card 309 thus comprises eight pairs of pellets 11 and 12 forming the contact-makers 100 and disposed in the respective sectors in eight different ways corresponding to eight different combinations of two points 310 from five.

The pairs 100 of pellets 11 and 12 are printed substantially along a circumference on the surface of the card 309, just like the openings 307 in the surface of the upper portion 302 of the support arrangement 301.

Corresponding to each pair of pellets 11 and 12 is a pair of studs 308 which are conventionally fixed on the card 309, one end 311 of which is in contact with one of the two pellets while the other end 312, with the studs extending vertically and perpendicularly to the card 309, passes through one of the two corresponding openings 307 to project slightly from the opening 307 in question.

The contact maker 45 and the general actuating switch 204 are mounted in the support arrangement 301 and cooperate with the conductor circuit which is printed on the card 309 in the same way as in the case of the support arrangement 201. In this respect, the card 309 also carries four conducting pellets 227, 17 and 228, 18, and two circular conducting ring portions 237.

The support arrangement 301 as described above may have associated therewith a plurality of series of different types of sets of information carrier cards, each set therefore comprising eight cards. Each card which is preferably of plastics material comprises an image which is to be associated with one of the eight images provided on the inclined faces 304 of the support arrangement.

Each card has the particular feature of having, under the image, a metal-plated face covered with an insulating coating except for two regions by means of which it is intended to co-operate with the ends 312 of the two studs 311 corresponding to the image of the face 304 with which the image of the card in question is to be associated.

The mode of use of this second embodiment is virtually identical to that of the previous embodiment.

When a diode 9 remains lit, the players must hurry to choose, from the cards which they have in their hand, the card that corresponds to the image of the inclined-surface sector of the support arrangement, which is associated with the diode 9 that is illuminated. The first of the players to make the proper association places the selected card on the corresponding inclined face of the support arrangement, so that the metal-plated layer on the card comes into contact with the ends 312 of the associated studs 308 and short-circuits the studs, thereby short-circuiting the two pellets 11 and 12 of the associated contact-maker 100. It will be noted that the different combinations of two points from five, with the corresponding structures in respect of the cards, prevent any incorrect association from being made.

The invention being thus described, it will be obvious that the same may be varied in many ways. Such variations are not to be regarded as a departure from the spirit and scope of the invention, and all such modifications as would be obvious to one skilled in the art are intended to be included with the scope of the following claims.

I claim:

1. A game comprising:

a support arrangement;

a first carrier member which is mounted on the support arrangement and on which is disposed a first series of pieces of information;

at least one second carrier member on which there is disposed a second series of pieces of information which can be respectively, operatively associated with those of the first information series;

a signalling means including at least one series of display elements for displaying another piece of information, which are disposed on said first carrier member of the support arrangement;

one of said display elements corresponding to each piece of information of said first information series;

means for actuating the signalling means and for causing said other piece of information to appear first successively at said display elements and then, after a given period, at only one of said display elements; and a series of means which are associated respectively with the pieces of information of said first information series and which are so arranged that the association of the piece of information of said first information series, corresponding to the display element at which, after said given period, said other piece of information appears, with the corresponding piece of information of said second information series, causes said other piece of information to disappear;

said means for actuating the display means being operatively arranged to cause said other piece of information to appear at said display elements in a random fashion;

said display elements being light sources operatively connected to an electrical circuit by a counter arranged to cause said light sources to flash and an oscillator for controlling the counter;

said pieces of information of said second information series being respectively disposed on insulated cards with a metal-plated face;

said means associated respectively with the pieces of information of said first information series includes a series of pairs of metal studs which are operatively disposed in twos on the first carrier member of the support arrangement and operatively correspond to the pieces of information of the second carrier member, and an individual series of pairs of metal studs of said first information series being capable of being short-circuited by engagement by one of said metal-plated cards of said second information series.

2. A game comprising:

a support arrangement;

a first carrier member which is mounted on the support arrangement and on which is disposed a first series of pieces of information;

at least one second carrier member on which there is disposed a second series of pieces of information which can be respectively, operatively associated with those of the first information series;

a signalling means including at least one series of display elements for displaying another piece of information, which are disposed on said first carrier member of the support arrangement;

a sound source which is disposed in the support arrangement;

one of said display elements corresponding to each piece of information of said first information series;

means for actuating the signalling means and for causing said other piece of information to appear first successively at said display elements and then, after a given period, at only one of said display elements, the sound source being actuated at the end of said given period; and a series of means which are associated respectively with the pieces of information of said first information series and which are so arranged that the association of the piece of information of said first information series, corresponding to the display element at which, after said given period, said other piece of information appears, with the corresponding piece of information of said second information series, modulates the emission of the sound source;

said means for actuating the display means being operatively arranged to cause said other piece of information to appear at said display elements in a random fashion;

said display elements being light sources operatively connected to an electrical circuit by a counter arranged to cause said light sources to flash and an oscillator for controlling the counter;

said pieces of information of said second information series being respectively disposed on insulated cards with a metal-plated face;

said means associated respectively with the pieces of information of said first information series includes a series of pairs of metal studs which are operatively disposed in twos on the first carrier member of the support arrangement and operatively correspond to the pieces of information of the second carrier member, and an individual series of pairs of metal studs of said first information series being capable of being short-circuited by engagement by one of said metal-plated cards of said second information series.

3. A game according to claim 1 or 2 wherein the means associated with said first information series and arranged to cause said other piece of information to disappear or to modulate the emission of the sound source comprise an insulating card disposed within the support arrangement and a series of pairs of conducting pellets printed on the card, the pairs of pellets being connected in parallel and associated respectively with the pieces of information of the first information series and so arranged that the two pellets of the same pair are short-circuited when the corresponding piece of information of said first information series is associated with the corresponding piece of information of said second information series.

4. A game according to claim 3 wherein there is provided a series of pairs of conducting studs which are respectively associated with the conducting pellets, in contact therewith, by way of one of their ends, and which project, by way of their other ends, out of the carrier member on which the first information series is disposed, and a series of cards which respectively carry the pieces of information of the second information series, each card comprising a metal-plated layer covered with an insulating coating, except for two given regions, by way of which it is intended to co-operate with one of the pairs of studs, by way of said other end thereof, in order to short-circuit said studs and therefore the associated pellets.

5. A game according to claim 4 wherein the two studs of one of said pairs of studs project out of said carrier member respectively by way of two openings selected from five which are provided in said carrier member.

6. A game according to claim 3 wherein the pieces of information of the second information series are respectively carried by carrier members of different given shapes, the carrier member on which the pieces of information of the first information series are disposed comprises recesses shaped respectively to receive the carrier members carrying the second pieces of information, and there is provided in the support arrangement a series of conducting means which are respectively associated with the first pieces of information and which are arranged so that, against the action of resilient return means, and when one of said carrier members carrying a second piece of information is engaged into the corresponding recess of the carrier member carrying the first pieces of information, the pellets of the pair associated with the corresponding first piece of information are short-circuited.

7. A game according to claim 6 wherein said conductor means provided for short-circuiting said pellets comprise blades of which at least one of the ends is conducting.

8. A game according to claim 7 wherein said blades are flexible and are mounted in the support arrangement so that their conducting ends, under the action of actuating balls, can come to bear respectively against the pairs of pellets of said card.

9. A game according to claim 8 wherein said carrier members for carrying said second pieces of information comprise a lug which is arranged to co-operate with said balls and to push same to actuate said blades.

10. A game comprising:

a set of pieces having different configurations;

means defining a playing surface;

means in said playing surface defining locations where each piece of said set is to be engaged;

a set of display elements each associated with one of said locations that when activated visibly indicates that a piece is to be engaged with said associated location;

a set of switches each associated with one of said locations and each operable only when a piece having the correct configuration for that location is engaged therewith; and an electrical operating circuit for said game to which the display elements and switches are connected, said circuit including a timer so that in a given initial period the display elements are activated successively and after said given period only one of said display elements is activated, said means being arranged to respond when the switch corresponding to the activated display element is operated by engagement with a piece of the correct configuration, said display elements being light sources which are flashed during said initial period by said electrical operating circuit by a counter arranged to cause said light sources to flash and an oscillator for controlling the counter.

11. A game according to claim 10, wherein said electrical operating circuit is caused to respond to operation of said switch corresponding to said activated display element by deactivating said visual display.

12. A game according to claim 10, wherein said electrical operating circuit includes a sound source that is activated at the end of said initial period and said circuit responds to operation of said switch corresponding to said activated display element by adjusting the emission of sound from said source.

13. A game according to claim 10, wherein said electrical operating circuit causes said display elements to be activated during said initial period in an apparently random fashion.

14. A game according to claim 10, wherein each piece in said set has a different and characteristic outline, said means in said playing surface defines a set of sockets each corresponding to the outline of one piece in said set so that one piece only fits into each socket and each switch is physically masked by said socket so that it is operable only by the correctly outlined piece.

15. A game according to claim 10, wherein said light sources are light-emitting diodes.

16. A game according to claim 15, wherein said actuating means comprise a static contact maker for triggering a sequence of flashing of said diodes.

17. A game according to claim 16, wherein the static contact maker comprises two coaxial metal-plated rings.

18. A game according to claim 16, wherein the static contact maker comprises two metal strips fixed along the side wall of the support arrangement.

19. A game according to claim 10, wherein the pieces in said set comprise insulated cards having an information bearing face and a metal-plated face, and said means in said playing surface includes a series of pairs of metal studs in each location and each physically located so as to be capable of being short-circuited when the correct one of said metal-plated cards is operatively engaged in said recess.

20. A game according to claim 19, wherein the means in said playing surface includes an insulating card disposed beneath said playing surface and a series of pairs of conducting pellets printed on the card, the pairs of pellets being connected in parallel and associated respectively with the locations where each card is to be placed and so arranged that the two pellets of the same pair are short-circuited when the correct card is operatively engaged with the location.

21. A game according to claim 20, wherein there is provided a series of pairs of conducting studs which are respectively associated with the conducting pellets, in contact therewith, by way of one of their ends, and which project, by way of their other ends, out of the locations in the playing surface and a series of cards each card comprising a metal-plated layer covered with an insulating coating, except for two given regions, by way of which it is intended to co-operate with one of the pairs of studs, by way of said other end thereof, in order to short-circuit said studs and therefore the associated pellets.

22. A game according to claim 21, wherein the two studs of one of said pairs of studs project out of said carrier member respectively by way of two openings selected from five which are provided in said carrier member.

23. A game according to claim 20, wherein there is provided beneath the playing surface a series of conducting means which form part of the switch associated with each location and which are arranged so that when one of said playing pieces is engaged into the corresponding location in the playing surface against the action of resilient return means the pellets of the pair associated with the corresponding playing piece are short-circuited.

24. A game according to claim 23, wherein said conductor means provided for short-circuiting said pellets comprise blades of which at least one of the ends is conducting.

25. A game according to claim 23, wherein said blades are flexible and are mounted in the support arrangement so that their conducting ends, under the action of actuating balls, can come to bear respectively against the pairs of pellets of said card.

26. A game according to claim 25, wherein said playing pieces include a lug which is arranged to co-operate with said balls and to push same to actuate said blades.

* * * * *